US006300850B1

(12) United States Patent
Kaegebein

(10) Patent No.: US 6,300,850 B1
(45) Date of Patent: Oct. 9, 2001

(54) TEMPERATURE COMPENSATING CAVITY BANDPASS FILTER

(75) Inventor: Daniel P. Kaegebein, Depew, NY (US)

(73) Assignee: TX RX Systems Inc., Angola, NY (US)

( * ) Notice: Subject to any disclaimer, the term of this patent is extended or adjusted under 35 U.S.C. 154(b) by 0 days.

(21) Appl. No.: 09/495,252

(22) Filed: Jan. 31, 2000

(51) Int. Cl.[7] ..... H01P 7/04; H01P 1/30; H01P 7/06; H01P 7/00

(52) U.S. Cl. ..... 333/222; 333/229; 333/232; 333/234

(58) Field of Search ..... 333/222, 229, 333/202, 226, 224, 232, 234

(56) References Cited

U.S. PATENT DOCUMENTS 3,740,677 * 6/1973 Kommrusch ..... 333/234
4,156,860 5/1979 Atia et al. ..... 333/229
4,644,303 * 2/1987 Jachowski et al. ..... 333/134
4,933,652 * 6/1990 Gaukel ..... 333/225
6,232,852 * 5/2001 Small et al. ..... 333/208

* cited by examiner

*Primary Examiner*—Robert Pascal
*Assistant Examiner*—Patricia T. Nguyen
(74) *Attorney, Agent, or Firm*—Simpson, Simpson & Snyder, PLLC

(57) ABSTRACT

A method and apparatus for frequency stabilization of cavity filters of the class including an outer tubular conductor and an inner conductor is effected by supporting the inner conductor of the resonant cavity by an apparatus comprised of a reference collar and an interface collar connected together by a means having a first coefficient of thermal expansion. The reference collar is structurally connected to the reference end of the outer tubular conductor by adjustable tuning means. It is not connected directly to the inner conductor. The inner conductor is structurally connected to the interface collar by a means having a second coefficient of thermal expansion. The first coefficient of thermal expansion and the second coefficient of thermal expansion are selected to provide compensation for the difference in thermal expansion between the outer conductor and the inner conductor of the cavity filter.

21 Claims, 3 Drawing Sheets

TEMPERATURE COMPENSATING CAVITY BANDPASS FILTER

BACKGROUND OF THE INVENTION

1. Field of the Invention

This invention relates to frequency stabilization, via thermal compensation, of highly selective bandpass cavity filters used in transmitter multicoupiers.

2. Discussion of the Related Art

In coaxial cavity filters or resonator, cavity resonance is determined by the length of the moveable center conductor. The moveable center conductor slides through the contact fingers of the stationary center conductor, effecting an adjustable length center conductor.

The moveable center conductor must be controlled in length, such that the cavity resonant frequency is maintained over a wide range of operating temperatures. The "operating" temperature may be a result of the ambient temperature with additional temperature rise due to localized self-generated heating of the cavity center conductor as a result of high RF circulating currents, characteristic of cavity resonance. The temperature rise of the center conductor appreciably above the temperature of the outer cavity shell causes the cavity to shift off frequency.

The usual temperature compensating techniques assume that the cavity structures will experience little temperature differential between the center probe and the outer cavity shell. A high nickel steel alloy, trademarked "Invar", is used to control the position of the moveable center conductor. It has a small temperature coefficient of expansion. In most designs, this Invar tuning rod is inside the center conductor, out of the RF current path. The remainder of the compensation is achieved by an external metallic extension on the top cap of the cavity through which the tuning rod travels. The tuning rod is locked at a specific height above the top cap of the cavity which is the reference point for the net change in length of the total center conductor. When the temperature increases, and the center conductor tends to expand in length, the metallic column above the cavity top cap also will expand, and pull the moveable center conductor back into the stationary portion, offsetting the inward expansion, though small, due to the Invar and any brass or copper extending beyond the Invar connection point. In real life, the external lock point is determined experimentally, since there are additional "drift factors" to handle, like the expansion or contraction of the diameters of the inner conductor and outer cavity shell diameter. The external compensation tower, or reverse compensation means uses a metal that expands considerably with temperature, such as aluminum. This reduces the length necessary to achieve the desired effect.

The situation is quite different when a bandpass cavity undergoes localized internal heating due to transmitter RF power dissipation. The cavity elements will heat up due to high circulating currents on resonance when the cavity insertion loss is increased in order to raise the operating Q and improve the cavity selectivity. The circulating resonance currents increase the internal heating of the center conductor and a temperature differential develops between the open end of the center conductor and the top cap of the cavity shell. This can be as much as a 70 Deg. F differential in high Q, highly selective cavity filters. The circumference of the center conductor is many times less than the circumference of the outer cavity shell. Since the same current flows in both structures, the current density per unit area is much greater in the center conductor, raising the temperature well above the outer shell. The external compensation column that locks the tuning rod now must become extremely hot to achieve temperature compensation. The top cap being welded to the outer shell dissipates much of the heat transferred to it by the center conductor at that point, and will not allow the external compensation column to rise sufficiently in temperature to achieve compensation.

In addition to the forgoing, there are other well known techniques for temperature compensating cavity filters, or resonators which are a resonant section of transmission line comprised of an inner and outer conductor. T. Lukkarila, U.S. Pat. No. 5,905,419 for "Temperature Compensation Structure for Resident Cavity", issued May 18, 1999 is exemplary of one such technique. In this example, the distance between the top of the resonator cavity and a resonator tap are maintained constant by constricting the cavity and resonator tap of dissimilar metals which have offsetting temperature coeficients of expansion, i.e., the rate of expansion of the resonator tap and cavity under a thermal load are selected so that the distance between the top of the resonator tap and the top of the cavity remain constant over a predetermined temperature range. Lukkarila teaches an alternate concept employing dissimilar metal strips which flex like a bimetal due to their interaction with cavity structure. The metal strips are positioned above the resonator tap so they're flexing effectively controls the distance between the top of the resonator tap and the electrical top (strip) of the cavity.

Unfortunately, in all of the various embodiments of Lukkaria, the temperature responsive elements are not heated uniformly when the device is subjected to a workload. A workload increases the temperature of the resonator tap and causes a thermally induced dimensional change which affects frequency response but the thermally responsive strips or wall structures of the cavity are not subjected to the same workload induced temperature variations, and therefore not immediately affected. An unacceptable delay occurs between the time that the dimensions of the probe of resonator tap change under a workload and the time required for the radiant heat of the probe to affect the temperature responsive elements within the cavity. During the period of temperature response lag, significant amounts of data may be lost as a result of the detuned interval.

Y. Kokubunji-shi, et al., U.S. Pat. No. 3,623,146 for "Temperature Compensated Cavity for a Solid-State Oscillator", issued Nov. 23, 1971 is exemplary of another technique wherein a part of the conductive wall constituting a resident cavity is formed as a movable plate. The plate is fixed to one end of a dielectric rod which has a high coefficient of linear expansion. The other end of the rod is fixed to an extension of the cavity resonator. As the dimensions of the cavity change in response to temperature variations, the linear expansion of the dielectric rod in response to temperature changes moves the movable plate to maintain the electrical length of cavity constant. In a further embodiment of this technique, the dielectric rod is threaded through the extension of the cavity resonator so that the location of the dielectric rod within the cavity may be mechanically varied to preset cavity resonator to it predetermined band. However, in all embodiments, the workload induced temperature changes, and therefore dimensional changes of elements within the cavity are not immediately transferred to the thermally responsive dielectric rod and significant delays in thermal corrections are experienced as in Lukkarila.

A variation of the Kokubunji-shi device is presented in U.S. Pat. No. 4,156,860 for "Temperature Compensation Apparatus for a Resident Microwave Cavity", issued to A. Atia, et al., on May 29, 1979. In this device, the movable wall is bonded to a stationary wall by a potting compound with a high coefficient of thermal expansion. The potting compound functions similar to the dielectric rod of Kokubunji-shi and it is also subject to unacceptable delays in thermal response time.

Devices such as the preceding provide temperature compensation but their response is slow, causing significant interrupt intervals in transmission systems using coaxial filters or resonators. When such devices are employed for high-speed data communications, significant data losses are encountered when the internal temperature of coaxial devices varies as a function of load because of the response lagged necessitated by the heat transfer from the electrical working elements of resonator to the thermal responsive mechanical elements.

OBJECTIVES OF THE INVENTION

In view of shortcomings of the prior art, a primary objective of the present invention is to provide thermally induced dimensional change compensation to a coaxial resonant structure which will instantaneously compensate as the temperature of the electrical working, elements varies.

A primary objective of the invention is for temperature compensation in those situations where the insertion loss of a cavity band pass filter must be increased to achieve the frequency selectivity necessary to combine multiple close spaced transmit channels. The increased insertion loss results in increased power dissipation in the cavity filter, which raises the operating temperature of the internal cavity structures. Without proper temperature compensation means, the cavity filter will shift in frequency. Therefore, the purpose of the objective of the present invention is to provide the frequency stability necessary for proper functioning at highly selective cavity insertion loss settings and/or elevated transmit power levels.

Another objective of the invention is to achieve frequency stability in a coaxial cavity design subjected to varying temperature gradations over its structure due to high RF circulating currents when connected to an RF transmitter.

A further objective is to achieve frequency stability in cavity resonators of varying resonant physical lengths, but not limited to ¼ wavelength, ¾ wavelength and 5/4 wavelength (nominal outside physical length).

Another objective is to provide temperature compensation in those situations required for varying cavity diameters.

A still further objective is to achieve temperature compensation at higher cavity insertion losses, and hence improve selectivity.

Another objective is to reduce the physical exposure to exterior high temperature compensating structures.

Another objective is to overcome the inability of external compensating structures to rise sufficiently in temperature to achieve temperature compensation, a limitation of the prior methodology.

A further objective is to reduce the effects of variables in ambient temperature, such as air conditioners cooling the temperature compensation column, defeating its purpose.

A still further objective is to allow the application of external cooling means without defeating the effectiveness of the temperature compensation action.

Another objective is to achieve temperature compensation using readily available, standard materials.

A further objective is to achieve temperature compensation with a reduction in the overall length of the cavity, eliminating the external reverse compensation column employed by the prior art.

SUMMARY OF THE INVENTION

The invention makes use of the principles of reverse compensation using metals with dissimilar coefficients of thermal expansion applied at a point where the resulting thermal action is fast in response and protected from external environmental influences. A structure is positioned inside a moveable probe near the open end, where the temperature rise is the greatest. The reference point for thermal expansion of the dissimilar metals is thereby transferred from the top cap of the cavity to a plane inside the moveable center conductor.

An "Invar" tuning rod lock point is located on a short column extending above tile cavity top cap. It is not an element adjusted in obtaining the temperature compensation. The Invar tuning rod connects to a "reference" brass collar inside the moveable probe. The reference collar and the interface collar are not directly attached to the moveable probe assembly.

DESCRIPTION OF THE PREFERRED EMBODIMENT

Figure 1:
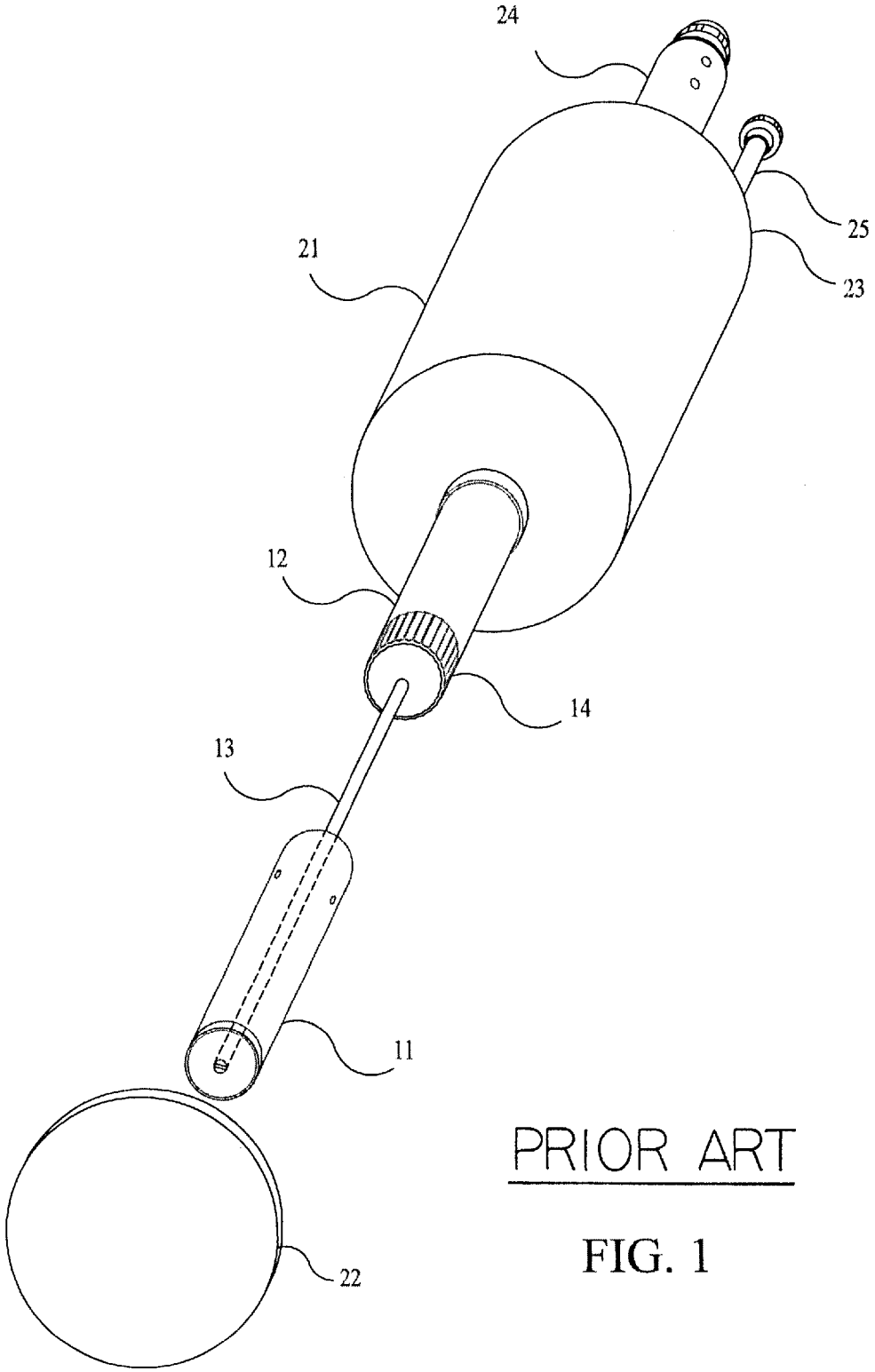
PRIOR ART FIG. 1
FIG. 1 is a simplified exploded view of a prior art cavity filter.

FIG. 1 is a simplified exploded view of a typical cavity filter found the prior art. It is basically a resonant section of transmission line, with an inner and outer conductor. In this simplified illustration, the inner conductor is comprised of a movable section 11 and stationary probe 12. The movable section is supported and positioned within the outer conductor 21 by a connecting rod 13 which passes through the center of the tubular stationary probe 12. The minimum "electrical length" for resonance of the section is one half wavelength. In such a section, the nominal length of the outer shell is about one half of the electrical halfwave required, i.e., ¼ wavelength. The length of the center conductor, movable section 11 and stationary probe 12, plus the radial distance to the outer edge of the outer conductor, 21, make up the balance of the electrical halfwave. Cavity resonators include a shell 21 with an attached end cap 22 as well as a support means for the stationary probe 12 and connecting rod 13. The connecting rod 13 is movable within a support means to vary the effective length of the inner conductor by moving the movable section 11 in and out of the stationary probe 12. Cavity resonators may also be ¾ wave or 5/4 wave length. This is to achieve a higher "Q" factor for greater selectivity. The cavity resonator in FIG. 1 is ¾ wavelength in the UHF band (450–520 Mhz), and ¼ wavelength in the VHF band (150–174 Mhz).

The outer shell or conductor of the cavity is made longer than the minimum ¼, ¾ or 5/4 wavelength required in order to minimize capacitive loading effects of the inner conductor to the closing end cap 22, such that the closest distance of the inner tuning probe or conductor 11 to the cap is never less than the distance of the inner conductor from the inside surface of the outer conductor or cavity shell 21.

The typical materials used for cavity RF conductive surfaces are copper, brass and aluminum, some of which may be silver or copper plated to improve electrical conductivity and hence the "Q" factor. The cavity structure of FIG. 1 has an adjoined aluminum outer shell with an aluminum supporting cap 23 heliarc welded to the outer shell 21 which includes a thermal compensation extension column 24 which is an extension of the inner stationary prob 12 and functions as the support means for the tuning/connecting rod 13 and the thereby provides all adjustment means for the position of the movable section 11 attached to the rod's other end. The inner probe assembly, or center conductor stationary section 12 is a silver plated copper and brass structure. The moveable section 11 is a silver plated brass structure. The stationary section has contact fingers 14 which are fabricated by slitting and polishing the open end of the tube before silver plating, and forming the contact taper, with proper tooling, before assembly into the cavity.

The cavity resonance is determined, primarily, by the length of the moveable center conductor 11 extending from the stationary center conductor 12 The moveable center conductor slides through the contact fingers of the stationary center conductor, effecting an adjustable length center conductor.

The moveable center conductor must be controlled in length, such that the cavity resonant frequency is maintained over a wide range of operating temperatures. The "operating" temperature may be a result of the ambient temperature with additional temperature rise due to localized self-generated heating of the cavity center conductor as a result of high RF circulating currents, characteristic of cavity resonance. A temperature rise of the center conductor appreciably above the temperature of the outer cavity shell will cause the cavity to shift off frequency.

In the prior art, the usual temperature compensating techniques assume that the cavity structures will experience little temperature differential between the center probe and the outer cavity shell. A high nickel steel, trademarked "Invar", is used to control the position of the moveable center conductor. This material has a small temperature coefficient of expansion. In most designs, this Invar tuning rod is inside the center conductor, out of the RF current path. The remainder of the temperature compensation is achieved by an external metallic extension 24 on the cap 23 of the cavity through which the tuning rod 13 travels. The tuning, rod is locked in and was a specific length extending into the cavity formed by the outer conductor 21 by the cap 23 of the cavity. This cap is the reference plane for the net change in length of the center conductor assembly relative to the outer conductor 21. When the temperature increases, and the center conductor expands in length, the metallic thermal compensation extension column 14 extending from the cavity cap 23 also expands, and pulls the moveable center conductor back into the stationary portion, offsetting the inward expansion. In prior art devices such as illustrated in FIG. 1, the external lock point is determined experimentally, since there are additional "drift factors" to handle, such as the expansion or contraction of the diameters of the inner conductor and outer cavity shell diameter.

The external compensation extension 24, or reverse compensation means, uses a metal that expands considerably with temperature, such as aluminum. This reduces the length necessary to achieve the desired effect.

The situation is quite different when a bandpass cavity undergoes localized internal heating due to transmitter RF power dissipation. The cavity elements heat up due to high circulating currents on resonance. When the cavity insertion loss is increased in order to raise the operating Q and improve the cavity selectivity, the circulating resonance currents increase the internal heating of the center conductor, and a temperature differential develops between the open end of the center conductor and the support cap 23 of the cavity shell This can be as much as a 70 Deg. F differential in high Q, highly selective cavity filters. The circumference of tile center conductor is many times less than the circumference of the outer cavity shell. Since the same current flows in both structures, the current density per unit area is much greater in the center conductor, raising the temperature well above the outer shell. The external compensation column 24 that locks the tuning rod now must become extremely hot to achieve temperature compensation. The support cap 23 being welded to the outer shell 21 dissipates much of the heat transferred to it by the center conductor at that point, and will not allow the external compensation column to rise sufficiently in temperature to achieve compensation.

Figure 2:
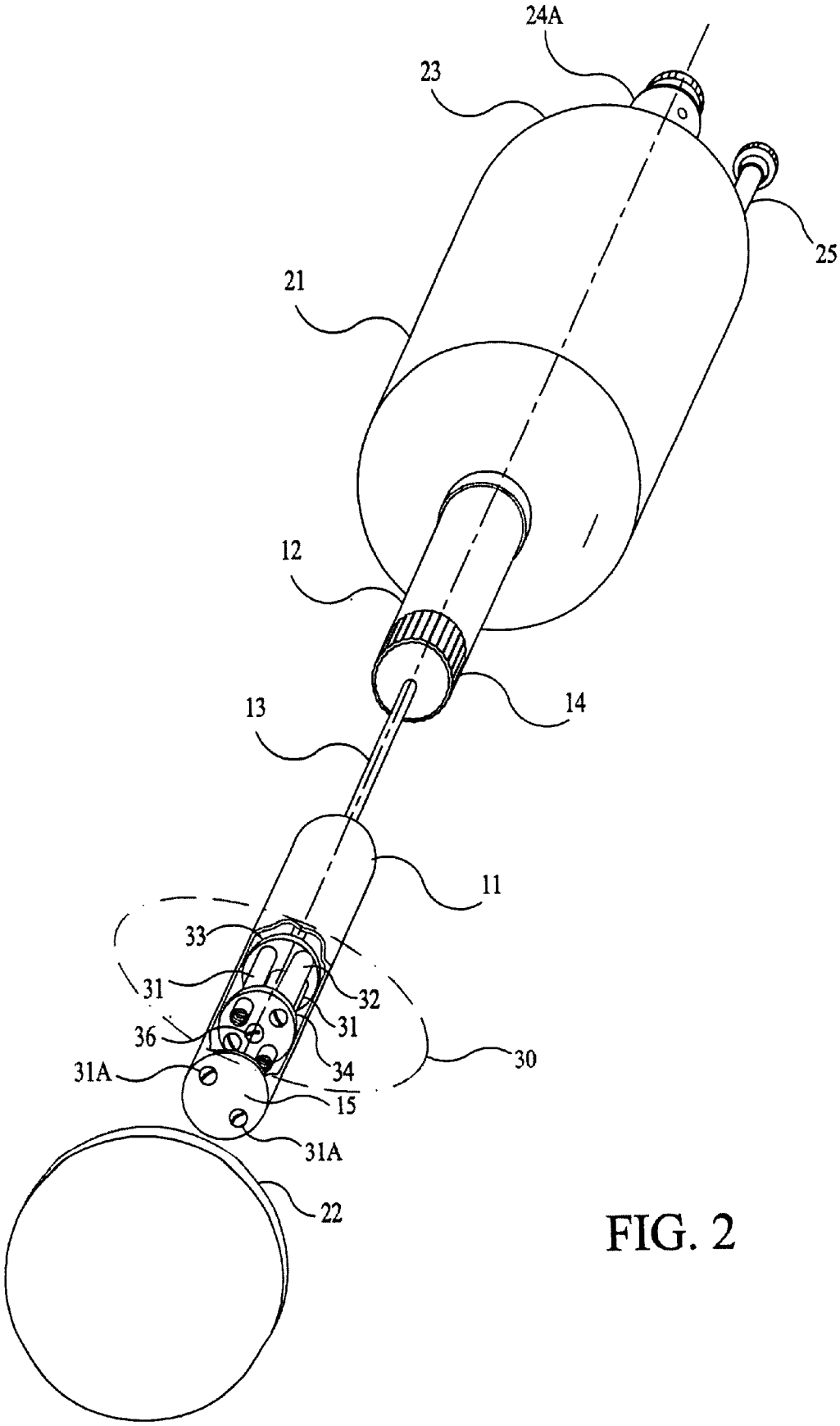
FIG. 2 is a simplified exploded view of a cavity filter incorporating the temperature compensating mechanism of the present invention.

This problem in the prior art is solved by the present invention which, as illustrated in FIG. 2, uses a temperature compensation assembly 30 to connect the movable probe 11 to the tuning support rod 13. The temperature compensation assembly, 30, is dimension to slide freely within the tubular body of the movable probe 11. To enhance the thermal conductivity between the movable probe and the temperature compensation assembly, the diameter of the temperature compensation assembly is as close as possible to the inside diameter of the movable probe but still avoid binding while the elements of the system undergo temperature induced dimensional changes.

Figures 3, 4, 5:
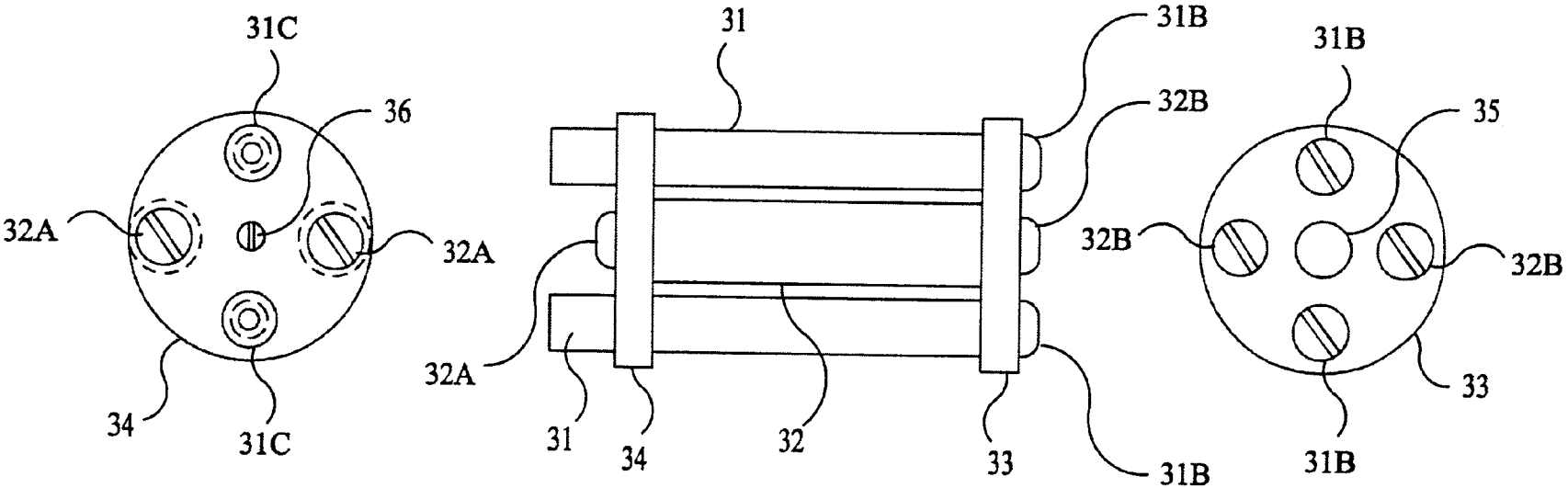
FIG. 3 is a side view of the compensation assembly.
FIG. 4 is an end view of the compensation assembly illustrating the reference collar.
FIG. 5 is an end view of the compensation assembly illustrating the interface collar.

The temperature compensation assembly is illustrated in detail and FIGS. 3, 4 and 5. It is comprised of an interface collar 33 and a reference collar 34 joined by a pair of aluminum bars 32 which are secured by screws 32A and 32B. The tuning support rod, 13, slidably passes through a bore 35 in the center of the interface collar 33 and is secured to the reference collar 34 by a screw 36. A pair of bars 31, preferably fabricated from a nickel steel alloy with 36% nickel, such as the alloy trademarked "Invar 36", are connected to the interface collar 33 by screws 31B and slidably pass through bores 31C in the reference collar 34. The nickel steel bars 31 are secured to the closed end 15 of the movable probe 11 by screws 31A, as illustrated in FIG. 2. In a preferred embodiment, the bars 31 and 32 are in the form of rods having, a circular cross section, but bars with any convenient cross-section may be used. Screws are used in the preferred embodiment to secure the components of the temperature compensation assembly together, but any convenient fastening means may be used.

The net effect of this arrangement is to move the center conductor 11 into and out or the stationary center conductor as a function of the difference in thermal expansion between the nickel steel rods and the aluminum rods when they are subjected to heat. The aluminum rods are of such a diameter that they are almost in contact with the inside wall of the moveable center conductor. This is the point of highest internal temperature. Therefore, heat transfer is much more rapid than to an external column that is attached to the stationary center conductor at the cavity top cap. Also, it will rise to a higher temperature due to its proximity to the wall of the movable center conductor. As a result, a much shorter length of aluminum rod is needed to achieve compensation.

The length ratio of nickel steel to aluminum is adjusted experimentally to achieve temperature compensation. This will vary as a function of the materials used in cavity construction, frequency, cavity resonant length, i.e., ¼ wave or ¾ wave or 5/4 wave, and cavity diameter.

In the preferred embodiment, the temperature compensation extension column 24 of the prior art is replaced by a locking mechanism 24A, see FIG. 2. The tuning support rod 31 slides through the locking mechanism 24A and is secured in the desired position by a set screw. The frequency of the cavity may be fine tuned by a number of different means, 25, such as a relatively short conductive rod that is slid or turned into the cavity with the aid of a knurled knob.

The foregoing is considered as illustrative only of the principles of the invention. Further, since numerous modifications and chances will readily occur to those skilled in the art, it is not desired to limit the invention to the exact construction and applications shown and described, and accordingly, all suitable modifications and equivalents may be resorted to, falling within the scope of the invention and the appended claims and their equivalents.

What is claimed is:

1. An apparatus for nullifying temperature induced dimensional changes in a mechanism relative to a reference plane, comprising:

a reference collar;

an interface collar;

means having a first coefficient of thermal expansion for connecting said reference collar to said interface collar;

means extending from said reference plane for supporting said reference collar and means having a second coefficient of thermal expansion for connecting said interface collar to said mechanism.

2. An apparatus for nullifying temperature induced dimensional changes in a mechanism relative to a reference plane as defined by claim 1, wherein said means having a first coefficient of thermal expansion is fabricated from aluminum.

3. An apparatus for nullifying temperature induced dimensional changes in a mechanism relative to a reference plane as defined by claim 1, wherein said means having a second coefficient of thermal expansion is fabricated from a nickel steel alloy.

4. An apparatus for nullifying temperature induced dimensional changes in a mechanism relative to a reference plane as defined by claim 3, wherein said nickel steel alloy is 36% nickel.

5. An apparatus for nullifying temperature induced dimensional changes in a mechanism relative to a reference plane as defined by claim 1, wherein said means having a first coefficient of the expansion and said means having a second coefficient of thermal expansion are comprised of a plurality of bars.

6. An apparatus for nullifying temperature induced dimensional changers in a mechanism relative to a reference plane as defined by claim 5, wherein said bars having a first coefficient of thermal expansion are configured as rods.

7. An apparatus for nullifying temperature induced dimensional changes in a mechanism relative to a reference plane as defined by claim 5 wherein said bars having a second coefficient of thermal expansion are configured as rods.

8. An apparatus for nullifying, temperature induced dimensional changes in a mechanism relative to a reference plane as defined by claim 1, wherein said means having a second coefficient of thermal expansion is longer than said means having a first coefficient of thermal expansion.

9. An apparatus for nullifying temperature induced dimensional changes in a mechanism relative to a reference plane as defined by claim 8, comprising:

passage means through said reference collar and said means having a second coefficient of thermal expansion extends from said interface collar through said passage,e means through said reference collar.

10. An apparatus for frequency stabilization of cavity filters of the class including an outer tubular conductor and an inner conductor, comprising:

said inner conductor includes a tube closed at one end and opened at the other;

a reference collar positioned within said inner conductor tube;

an interface collar positioned within said inner conductor tube;

means having a first coefficient of thermal expansion for connecting said reference collar to said interface collar;

a reference plane cap defining one end of said outer tubular conductor; means extending into said outer tubular conductor from said reference plane cap for supporting said reference collar; and means positioned within said inner conductor having a second coefficient of thermal expansion for connecting said interface collar to said closed end of said inner conductor tube.

11. An apparatus for frequency stabilization of cavity filters of the class including an outer tubular conductor and an inner conductor as defined by claim 10, wherein said means having a first coefficient of thermal expansion is fabricated from aluminum.

12. An apparatus for frequency stabilization of cavity filters of the class including an outer tubular conductor and an inner conductor as defined bay claim 10, wherein said means having a second coefficient of thermal expansion is fabricated from a nickel steel alloy.

13. An apparatus for nullifying temperature induced dimensional changes in a mechanism relative to a reference plane as defined by claim 12, wherein said nickel steel alloy is 36% nickel.

14. An apparatus for frequency stabilization of cavity filters of the class including an outer tubular conductor and an inner conductor as defined by claim 10, wherein said means having a first coefficient of thermal expansion is comprised of a plurality of rods.

15. An apparatus for frequency stabilization of cavity filters of the class including an outer tubular conductor and an inner conductor as defined by claim 10, wherein said means having a second coefficient of thermal expansion is comprised of a plurality of rods.

16. An apparatus for frequency stabilization of cavity filters of the class including an outer tubular conductor and an inner conductor as defined by claim 10, wherein said means having a first coefficient of thermal expansion is comprised of a plurality of bars.

17. An apparatus for frequency stabilization of cavity filters of the class including an outer tubular conductor and an inner conductor as defined by claim 10, wherein said means having a second coefficient of thermal expansion is comprised of a plurality of bars.

18. An apparatus for frequency stabilization of cavity filters of the class including an outer tubular conductor and an inner conductor as defined by claim 10, wherein said means having a second coefficient of thermal expansion is longer than said means having a first coefficient of thermal expansion.

19. An apparatus for frequency stabilization of cavity filters of the class including an outer tubular conductor and an inner conductor as defined by claim 17, comprising:

passage means through said reference collar; and said means having a second coefficient of thermal expansion extend from said interface collar through said passage means through said reference collar.

20. A method for frequency stabilization of cavity filters including a process for compensating for differences in the coefficient of thermal expansion of the various components comprising cavity filters, including the steps of:

connecting a reference collar to an interface collar by a means having a first coefficient of thermal expansion;

positioning said interface and reference collars within an inner tubular conductor of said cavity filter;

supporting said inner tubular conductor by attaching one end to said interface collar by a means having a second coefficient of thermal expansion; and supporting said interface collar by a means connecting said reference collar to a cap forming one end of an outer conductor of said cavity filter.

21. A method for frequency stabilization of cavity filters including a process for compensating for differences in the coefficient of thermal expansion of the various components comprising cavity filters as defined by the steps of claim 20, wherein said first coefficient of thermal expansion and said second coefficient of thermal expansion are selected to provide compensation for the difference in thermal expansion between said outer conductor and said inner conductor of said cavity filter.

* * * * *